US007997789B2

(12) United States Patent
Smith et al.

(10) Patent No.: US 7,997,789 B2
(45) Date of Patent: Aug. 16, 2011

(54) CLOCK FOR DISPLAYING COLLECTIBLES

(76) Inventors: Judd C. Smith, Lake Geneva, WI (US); Brett Rammel, Muskego, WI (US)

( * ) Notice: Subject to any disclaimer, the term of this patent is extended or adjusted under 35 U.S.C. 154(b) by 560 days.

(21) Appl. No.: 11/959,100

(22) Filed: Dec. 18, 2007

(65) Prior Publication Data

US 2009/0154302 A1 Jun. 18, 2009

Related U.S. Application Data

(60) Continuation-in-part of application No. 29/279,204, filed on Apr. 23, 2007, now abandoned, which is a division of application No. 29/146,926, filed on Aug. 20, 2001, now Pat. No. Des. 541,177.

(51) Int. Cl.
*G04B 37/00* (2006.01)
*G04B 19/04* (2006.01)

(52) U.S. Cl. ..... 368/278; 368/228; 368/285; D10/2; D10/124

(58) Field of Classification Search ..... 368/76, 368/88, 223, 228, 232, 276, 278, 285, 309, 368/80; D10/1–29, 123, 124, 126, 129
See application file for complete search history.

(56) References Cited

U.S. PATENT DOCUMENTS

| | | | | | |
|---|---|---|---|---|---|
| 410,808 | A | * | 9/1889 | Schelker | 40/486 |
| D31,501 | S | * | 9/1899 | Clarke | D10/124 |
| 1,085,206 | A | * | 1/1914 | Horstman | 368/81 |
| 1,689,471 | A | * | 10/1928 | Andrusis | 40/564 |
| D146,174 | S | | 1/1947 | Dow | |
| D146,757 | S | | 5/1947 | Webb | |
| 2,998,664 | A | * | 9/1961 | McIntire | 40/473 |
| 3,139,977 | A | | 7/1964 | Burdick | |
| 3,229,809 | A | | 1/1966 | Spadaro | |
| 3,277,646 | A | * | 10/1966 | Howard, Sr. | 368/281 |
| 3,624,832 | A | | 11/1971 | Dunn | |
| 3,638,418 | A | * | 2/1972 | Spadini | 368/74 |
| 3,733,809 | A | * | 5/1973 | Reiter et al. | 368/232 |
| 4,247,930 | A | * | 1/1981 | Martin | 368/84 |
| 4,320,831 | A | | 3/1982 | Szabo et al. | |
| 4,364,472 | A | | 12/1982 | Waldmeier | |
| 4,378,876 | A | | 4/1983 | Szabo et al. | |
| 4,385,688 | A | | 5/1983 | Grant | |
| 4,399,910 | A | | 8/1983 | Gutentag | |
| 4,425,997 | A | | 1/1984 | Grant | |
| 4,525,077 | A | * | 6/1985 | Ketner | 368/77 |
| D283,877 | S | | 5/1986 | Faciane | |

(Continued)

OTHER PUBLICATIONS http://www.electrictime.com/products/; Electric Time Company Products; Aug. 25, 2001.

(Continued)

*Primary Examiner* — Vit W Miska

(57) ABSTRACT

A clock for displaying collectibles and method of displaying collectibles within the clock is disclosed. The clock is a customizable device comprising a core having a first surface, a second surface opposite to the first surface and a thickness portion connecting the first and the second surfaces. The clock further includes a first structure removably attached to the first surface of the core and a clock movement received in an opening in the core. Also provided is a plurality of recesses, each of the recesses having a depth and configured and dimensioned to receive a collectible. In at least some embodiments, the recesses are provided in the core while in at least some other embodiments, the recesses are provided in the first structure of the clock. The collectibles are additionally secured in position within the clock by way of one or more adaptors.

3 Claims, 7 Drawing Sheets

U.S. PATENT DOCUMENTS

| | | | | | |
|---|---|---|---|---|---|
| 4,915,214 | A | | 4/1990 | Wieder | |
| D312,787 | S | * | 12/1990 | Ives | D10/2 |
| D314,355 | S | | 2/1991 | Aydelott | |
| 4,993,006 | A | * | 2/1991 | Oshima et al. | 368/231 |
| D338,837 | S | * | 8/1993 | Ungacta | D10/7 |
| 5,269,086 | A | * | 12/1993 | Tomes | 40/486 |
| 5,604,717 | A | * | 2/1997 | Wang | 368/223 |
| 5,654,940 | A | * | 8/1997 | Wei | 368/28 |
| D411,805 | S | * | 7/1999 | McDowell et al. | D10/2 |
| 6,052,338 | A | * | 4/2000 | Shevins | 368/223 |
| D443,830 | S | * | 6/2001 | Young | D10/2 |
| 6,525,998 | B1 | | 2/2003 | Taylor | |
| 6,556,514 | B2 | * | 4/2003 | Fernandez | 368/223 |
| 7,126,881 | B2 | | 10/2006 | Cooper et al. | |
| 7,180,830 | B1 | | 2/2007 | Cotsen | |
| 7,267,480 | B1 | * | 9/2007 | Hasson | 368/286 |
| 7,406,004 | B1 | * | 7/2008 | Hiromori | 368/88 |

OTHER PUBLICATIONS http://www.noveltyclocks.com/; Novelty Clocks—Office, Incentive, Nautical, Outdoor and Hobbyist Clocks; Aug. 26, 2001.

http://is6.pacific.net.hk/~pmlhkaa/; Pace Mark Limited; Sep. 12, 2001.

http://www.hkexporter.net/watchandclock/silconelectronics.html; Watch Clock—Silicon Electronics—Hong Kong Exporter Net—Export Import Manufacturer; Sep. 12, 2001.

http://www.hkexporter.net/watchandclock/micron.html; Watch Clock—Micron Technology—Hong Kong Exporter Net—Export . . . ; Sep. 12, 2001.

http://www.hkexporter.net/watchandclock/fullswing.html; Watch Clock—Fullswing Industrial Co. Ltd.—Hong Kong Exporter Net . . . ; Sep. 12, 2001.

http://www.hkexporter.net/ watchandclockfossil.html; Watch Clock—Fossil (Newtime) Ltd.—Hong Kong Exporter Net—Export . . . ; Sep. 12, 2001.

http://www.hkexporter.net/watchandclock/dailywin.html; Watch Clock—Dailywin Group—Hong Kong Exporter Net—Export Import Manufacturer . . . ; Sep. 12, 2001.

http://www.hkexporter.net/watchandclock/artfield/html; Watch Clock—Artfield Manufacturing—Hong Kong Exporter Net—Exp . . . ; Sep. 12, 2001.

http://www.verdin.com/verdin; Aug. 26, 2001.

http://www.clock-wise.com/; Clockwise Homepage; Aug. 25, 2001.

http://www.kingsrivermall.com/timeworks/; Timeworks clocks Collection—Kings River Gifts; Aug. 26, 2001.

www.franklinmint.com; About Us; Aug. 26, 2001.

http://www.franklinclock.com/copro.htm; Celebrating 30 Years of Clock Manufacturing—Franklin Instrument Company; Aug. 25, 2001.

http://www.clockmakers.com/html/limited.htm; Sinclair Harding—makers of the worlds finest clocks; Aug. 26, 2001.

http://www.oldandnew.com/; Clocks, Novelty clocks, Cuckoo Clocks, Pocket Watches, Hourglass; Aug. 26, 2001.

http://www.selcotime.com/home/contact_us.htm; Custom Logo Watches—Contact Selco Time clocks, corporate gifts, awards and promotiona . . . ; Aug. 25, 2001.

http://www.klockit.com/clockcontest.
asp?id=0109275515646241153300 39;Klockit.com, Aug. 26, 2001.

http://www.globalsources.com/MAGAZINE/TP/0004/WALL02.
HTM; Global Sources Timepieces; Aug. 26, 2001.

http://www.accutec.co.uk; Accutec.co.uk; Aug. 25, 2001.

* cited by examiner

CLOCK FOR DISPLAYING COLLECTIBLES

CROSS-REFERENCE TO RELATED APPLICATIONS

This application claims priority under 35 U.S.C. §120 to and is a continuation-in-part of U.S. Design patent application No. 29/279,204, filed Apr. 23, 2007, now abandoned which is a divisional application of U.S. Design patent application No. 29/146,926, filed Aug. 20, 2001 and now U.S. Design Pat. No. D541,177, the entireties of both of which are incorporated by reference herein.

FIELD OF THE INVENTION

The invention relates to a clock and, more particularly, to a clock device for displaying collectibles.

DESCRIPTION OF THE RELATED ART

Clocks have been used for many years for keeping and displaying time. Typically, clocks are available in a wide variety of styles, types and versions allowing for wide ranging uses and style preferences. Clocks have been used for displaying collectibles and other personal memorabilia. While a wide variety of clock designs have been created, the visual appearance, functionality and the collectibles displayed within most clocks are not changeable (e.g., changing the displayed collectibles) and/or easily customizable by the user after creation. Moreover, the limited customizability of such clocks often involves replacing a number of intricate pieces and complicated mechanisms, making the manufacturing more expensive and the use more difficult for people thereby limiting the customer base for the clock.

Additionally, during customization, the time displayed by some clocks can be affected in that the clock needs to be reset or re-synchronized to display the correct time. As a result, customization or individualization of the clock may be more difficult and time consuming than expected, thereby defeating the purpose of the clock. Accordingly, it would be advantageous to provide a clock in which the appearance of the clock and the collectibles displayed within the clock could be easily and conveniently changed as desired. It would further be advantageous to provide a clock in which various portions of the clock could be simply and easily changed as desired by a user of virtually any age. Finally, it would be desirable to provide a clock in which customizing the clock did not affect the time displayed by the clock or affect the user's ability to view the displayed time.

SUMMARY OF THE INVENTION

In one aspect, the present invention relates to a clock for displaying collectibles. In at least some embodiments of the present invention, the clock comprises a core having a first surface, a second surface opposite the first surface and a thickness portion connecting the first and the second surfaces. The first surface further includes a plurality of recesses, wherein each of the plurality of recesses has a depth configured and dimensioned to receive a collectible. The clock further includes a first structure that is removably attached to the first surface of the core, and a clock movement received in an opening in the core.

In another aspect, the present invention relates to a clock for displaying collectibles, which comprises a core having a first side and a second side, a first structure capable of being connected to and covering at least a portion of the first side of the core, the first structure having a formed therein a plurality of recesses, each of the plurality of recesses having a depth. Also provided is a clock movement received in an opening in the core.

In still another aspect, the present embodiment provides a method of displaying collectibles within a clock. The method comprises providing a providing a clock including a core including a first surface, a second surface, a time movement, and a first structure covering at least a portion of the first surface of the core, the core and the first structure connected in operable association and at least one of the core and the first structure including a plurality of recesses therein; and securing a plurality of collectibles within the plurality of recesses.

Other aspects and embodiments are contemplated and considered within the scope of the invention.

BRIEF DESCRIPTION OF THE DRAWINGS

Before explaining embodiments of the invention in detail, it is to be understood that the invention is not limited in its application to the details of construction and the arrangement of the components set forth in the following description or illustrated in the drawings. The invention is capable of other embodiments and being practiced or carried out in various ways. Also, it is to be understood that the phraseology and terminology employed herein is for the purpose of description and should not be regarded as limiting. Preferred exemplary embodiments of the invention are illustrated in the accompanying drawings, in which like reference numerals represent like parts throughout and in which.

DETAILED DESCRIPTION

Figure 1A:
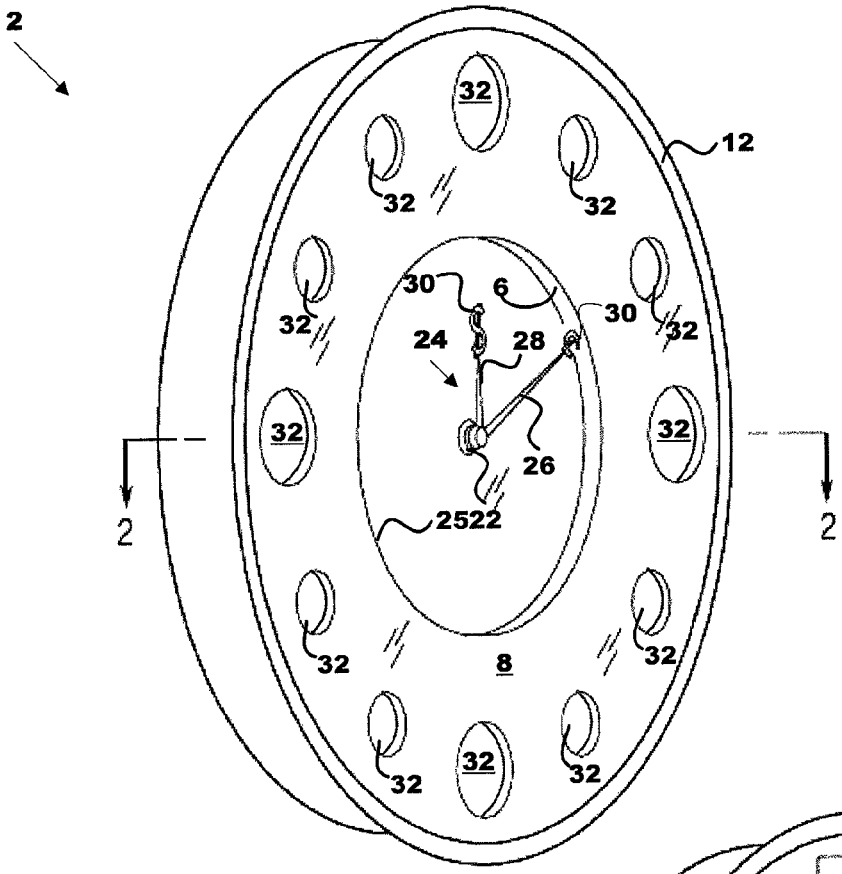
FIG. 1A is a perspective view of a first clock made in accordance with a first embodiment of the clock being employed for displaying collectibles in accordance with at least some embodiments of the present invention
Figure 1B:
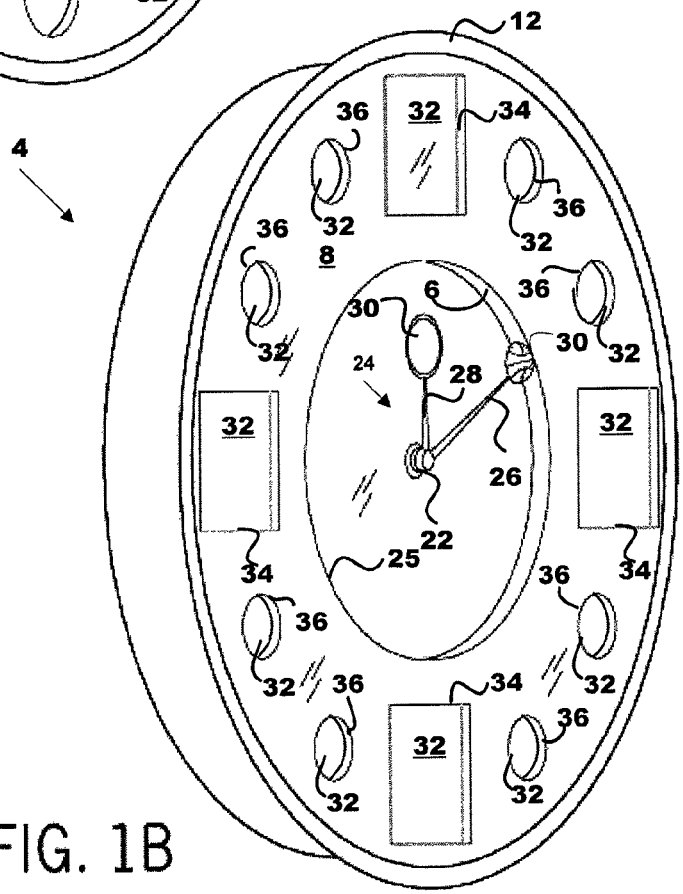
FIG. 1B is a perspective view of a second clock made in accordance with a second embodiment of the clock being employed for displaying collectibles in accordance with at least some embodiments of the present invention.

Referring to FIGS. 1A, 1B, 1C and 1D, perspective views of exemplary clocks 2 and 4, respectively, are shown in accordance with at least some embodiments of the present invention. The clocks 2 and 4 can be used for displaying a wide variety of collectibles such as, sport collectibles (e.g., golf balls, collector cards, hot wheels), valuables (e.g., coins, gems, stamps) and toys (e.g., Beanie Babies® toys, Star Wars® action figures). The clocks 2 and 4 can also be used for displaying other personal memorabilia and items of interest. FIGS. 1A and 1B of the drawings illustrate two exemplary clocks for displaying collectibles. In particular, the clock 2 of FIG. 1A is designed for displaying circular collectibles (e.g., coins, golf balls) of various sizes, while the clock 4 of FIG. 1B is designed for displaying rectangular collectibles (e.g., basketball cards) and circular collectibles.

As shown, the clocks 2 and 4 are analog clocks that can be any of a wide variety that are commonly available and frequently used. For example, the clocks 2 and 4 can be wall clocks, table clocks, alarm clocks, pocket clocks and the like. Additionally, while the clocks 2 and 4 as shown are analog time piece devices, each of those clocks can be digital clocks as well. Further, although each of the clocks 2 and 4, as shown, in the present embodiment are oval in shape, other shapes, sizes and designs of the clocks are contemplated and considered within the scope of the present invention. For example, in at least some embodiments of the present invention, the clocks 2 and 4 can be square, triangular, rectangular, or any other desired geometrical shape. In alternate embodiments, the clocks 2 and 4 can assume any non-geometrical shapes as well.

Figure 1C:
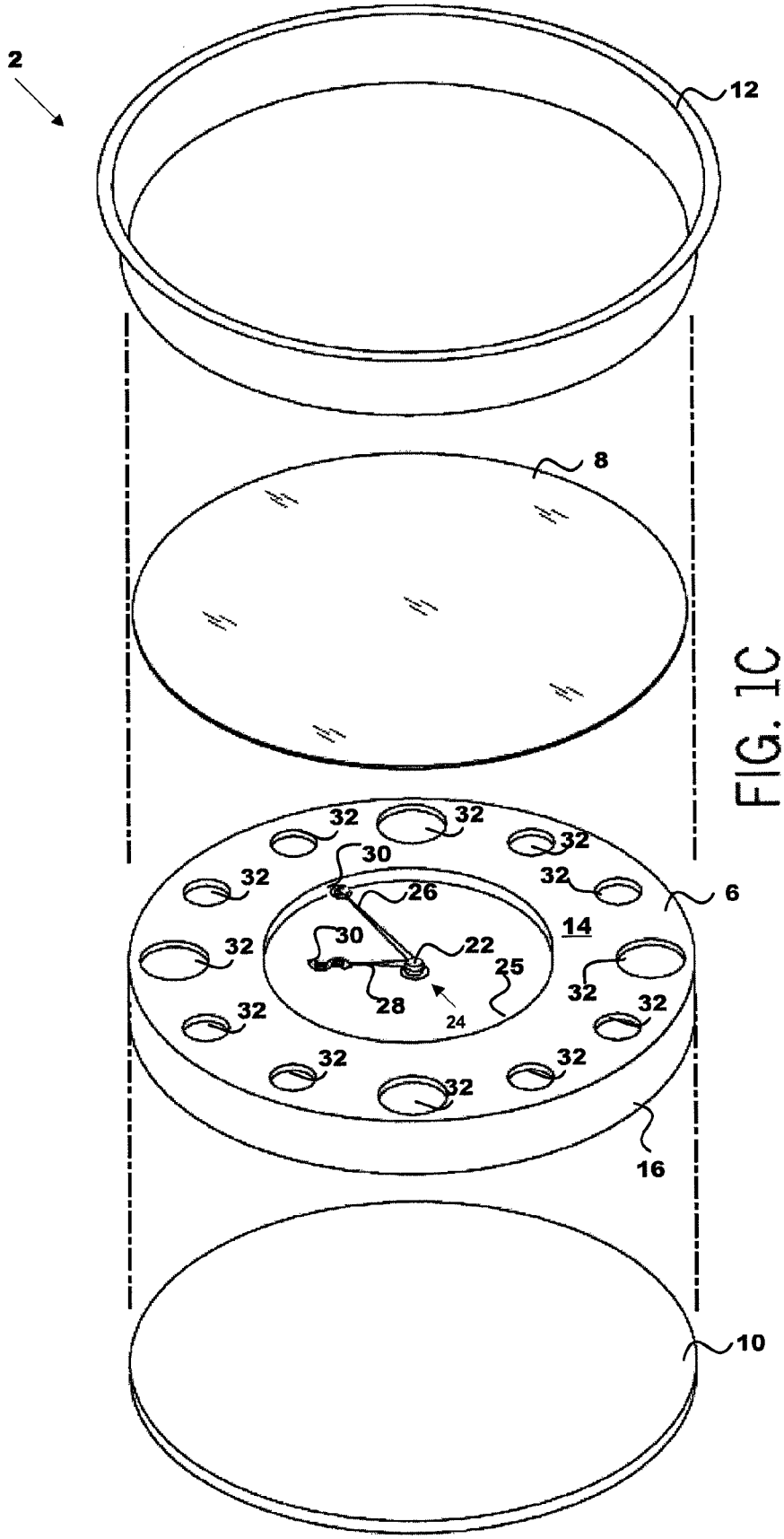
FIG. 1C is an exploded view of the first clock of FIG. 1A.
Figure 1D:
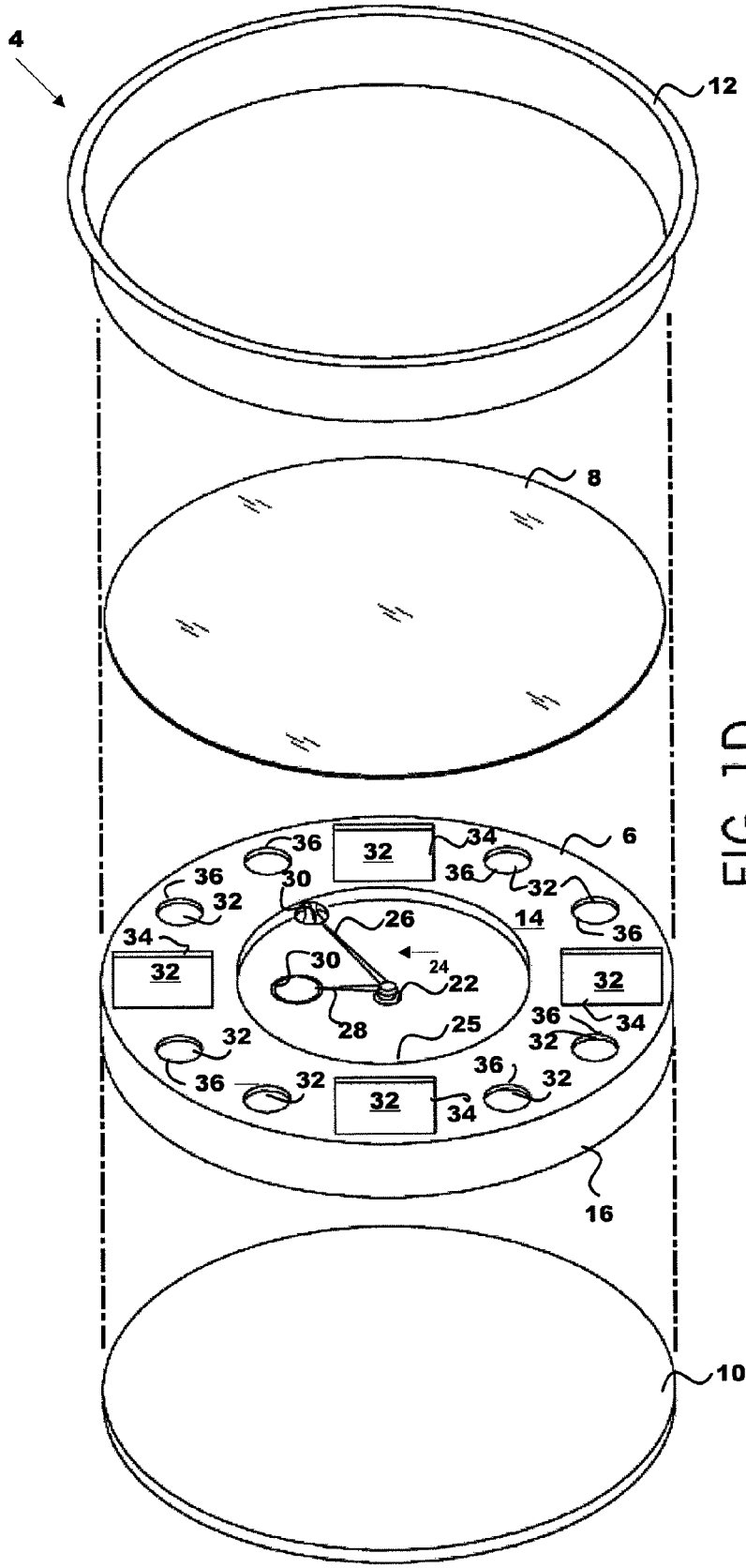
FIG. 1D is an exploded view of the second clock of FIG. 1B.

With respect to the clocks 2 and 4, each of those clocks includes a core 6 that is covered by a face plate 8, and in some embodiments, also includes a back plate 10 (See FIGS. 1C and 1D). In at least some embodiments of the present invention, the core 6 and the face plate 8 and the back plate 10 are held together in operational association by an outer rim 12. Additional components such as chimes, gongs, pendulums, clock holders, day/date setting components can be provided in other embodiments of the clock 2 and 4. In alternate embodiments, other electronic, mechanical, functional and/or decorative features can be present as well.

With respect to the core 6 in one embodiment, each of the face plate 8 and the back plate 10 are removable, detachable and/or openable components to enable the user to customize the appearance of the clock and/or the change the collectibles displayed within. The face plate 8 and the back plate 10 are contemplated as being removably attached to a front surface 14 (See FIGS. 1C and 1D) and a back surface 16 (See FIGS. 1C and 1D), respectively, for covering at least a portion thereof respectively the core 6. With respect to the face plate 6, in at least some embodiments of the present invention, the face plate 6 is transparent, convex-shaped, flat (or substantially flat), while the back plate 10 is a flat (or substantially flat) structure providing a flush surface for mounting the clocks 2 and 4 on a wall. Further, each of the core 6, the face plate 8 and the back plate 10 can be constructed of any suitable materials, including, for example, metal, plastic, wood, rubber, glass or any other materials.

Additionally, as indicated above, the core 6, the face plate 8 and the back plate 10 are connected to one another in operable association via the outer rim 12. Typically, the rim 12 is a detachable rim 12 constructed as a single piece, that, in at least some embodiments of the present invention, can be frictionally fitted (e.g., by applying pressure) around the outer periphery of the core 6, the face plate 8 and the back plate 10. The configuration of the rim need not be as illustrated. For example, the outer rim 12 need not include the lip shown in the drawings and the rim 12 can include multiple pieces. To the extent that the rim 12 is employed for connecting the core 6, the face plate 8 and the back plate 10, any of a wide variety of conventional holding mechanisms for removably holding those components together can be employed. For example, in some embodiments, the rim 12 can be mechanically secured by way of fasteners such as screws, nails and bolts. In other embodiments, soldering, gluing, crimping, snapping, friction fitting and other types of engagement and/or fastener(s) can be utilized. In at least some alternate embodiments, the outer rim 12 need not be present. Rather, other types of engaging and or fastening mechanisms can be employed for holding the various components (e.g., the core 6, the face plate 8 and the back plate 10) of the clocks 2 and 4.

Further, although the illustrated embodiment employs a single outer rim 12 for holding the core 6, the face plate 8 and the back plate 10, in other embodiments, two or more rims holding one or more sections (e.g., core, face plate and back plate) of the clocks 2 and 4 can be used. For example, in at least some embodiments, two separate rims, with one rim holding the core 6 and the back plate 10 and another rim holding the core and the face plate 8 can be used. The rim 12 can be made of any of a wide variety of rigid, semi-rigid and/or flexible materials including, for example, wood, metal, plastic, rubber and the like. For embodiments in which the face plate 8 and/or the back plate 10 covers only a portion of the core 6, those components need not be connected to the core by the outer rim 12. Rather, those components can be removably held with other types of engagement and/or fastener(s) relative to the core 6.

Additionally, the core 6 and the face plate 8, either separately or in combination house various electrical and mechanical components of the clocks 2 and 4. For example, the clocks 2 and 4 include a clock movement 18 (See FIGS. 2-4) positioned within an opening 19 extending through the core 6. The clock movement 18 can be any of a mechanical, a quartz or any other type of clock movement for keeping time. The clock movement 18 includes a shaft 20 and a dial 22 including minute and hour hands 26 and 28, respectively, for displaying the current time. The minute hand 26 and the hour hand 28 are collectively referred herein as indicator arms 24. In at least some embodiments of the present invention, the indicator arms 24 are disposed in a recess 25 on the front surface 14 of the core 6 to prevent any hindrance to the movement of the indicator arms 24 by collectibles displayed on the front surface 14 of the core 6. Nevertheless, in alternate embodiments, the minute and the hour hands 26 and 28, respectively, can be flush with the front surface 14 and/or be situated on a projection extending therefrom.

In addition to providing hour and minute time indications, the dial 22 can be utilized for providing additional functions. For example, seconds, date, day of the week, year, phases of the moon etc. can be provided as well. Additionally, the distal end portions 30 of the minute and the hour hands 26 and 28, respectively, can be modified to include one or more decorations, such as symbols, attributes, badges, denotations, designs, devices, emblems, figures, images, indications, letters, logos, marks, motifs, notes, numerals, patterns, representations, signs, stamps, tokens, and the like. Such decorations can conform to the theme and spirit of the collectible displayed within the clock, or otherwise serve to enhance the aesthetic value of the clock. For example, as shown in FIG. 1A, for displaying coin collectibles, the minute hand 26 includes a ¢ symbol to represent cents, while the hour hand 28 includes a dollar ($) symbol to represent dollars. Relatedly, as shown in FIG. 1B, for displaying collector basketball cards within the clock 4, the minute hand 26 can be designed to depict a basketball, while the hour hand 28 can be designed like a basketball hoop. Other decorations can be used as well.

Additionally, although only the distal portions 30 of the indicator arms 24 have been shown as including decorations, in other embodiments, the entire minute and/or hour hands 26 and 28, respectively, can be modified to conform to the collectible theme. For example, the hour hand 28 of the clock 2 can itself be designed to have a "$" shape. Further, in at least some embodiments of the present invention, the front surface 14 of the core 6 can itself be decorated and/or coated to have an appearance conforming to the collectible theme. Additional decorative knickknacks and features can be present in the clocks 2 and 4 as well.

Referring still to FIGS. 1A and 1B, the front surface 14 of the core 6 is provided with a plurality of recesses 32 for holding a wide variety of collectibles. In at least some embodiments of the present invention, the recesses 32 are provided along an outer periphery of the front surface 14 of the core 6 corresponding to positions of "hours" on a conventional clock. Nevertheless, in other embodiments, the recesses 32 can be positioned anywhere on the front surface 14 of the core 6. Although the recesses 32 have been shown to be in the core section 6 of the clocks 2 and 4, the recesses need not always be in the core. Rather, as will be described below, in at least some other embodiments, the recesses can be in the face plate 8 of the clock.

The recesses 32 (irrespective of whether the recesses are in the core 6 or the face plate 8) can assume a variety of shapes, sizes and orientations depending upon the structure and form of the collectible to be displayed therein. For example, as shown in FIG. 1A, the recesses 32 are circular or substantially circular in shape. Such circular recesses can be optimum for holding coin collectibles, golf balls, gems and other circular (or substantially circular) and spherical (or substantially spherical) objects. Relatedly, as shown in FIG. 1B, a subset 34 of the recesses 32 are rectangular (or substantially rectangular) in shape while another subset 36 of the recesses are circular in shape. Rectangular recesses can be appropriate for holding, for example, collector cards, stamps, hot wheels. Other geometric and non-geometric shapes, depending upon the collectible to be displayed, are contemplated and considered within the scope of the present invention. Further, more than one recess shape can be present in a single clock for displaying an assortment of collectibles, as is illustrated in FIG. 1B.

The size and depth of the recesses 32 is typically dependent upon the size and thickness of the collectible to be displayed. However, collectibles having sizes smaller than the recesses of the clocks 2 and 4 can still be displayed in an embodiment of the present invention by virtue of a variety of adaptors, as will be discussed below. In particular, at least one embodiment of the present invention provides a mechanism by which collectibles of different shapes, sizes and thicknesses can be displayed within a recess of a specific shape, size and depth. To the extent that such adaptors allow collectibles of varying sizes to be conveniently displayed within the recesses of the clocks 2 and 4, the present invention provides a manner of easily and efficiently customizing the appearance of the clock in addition to changing, removing and/or adding collectibles.

Figure 2:
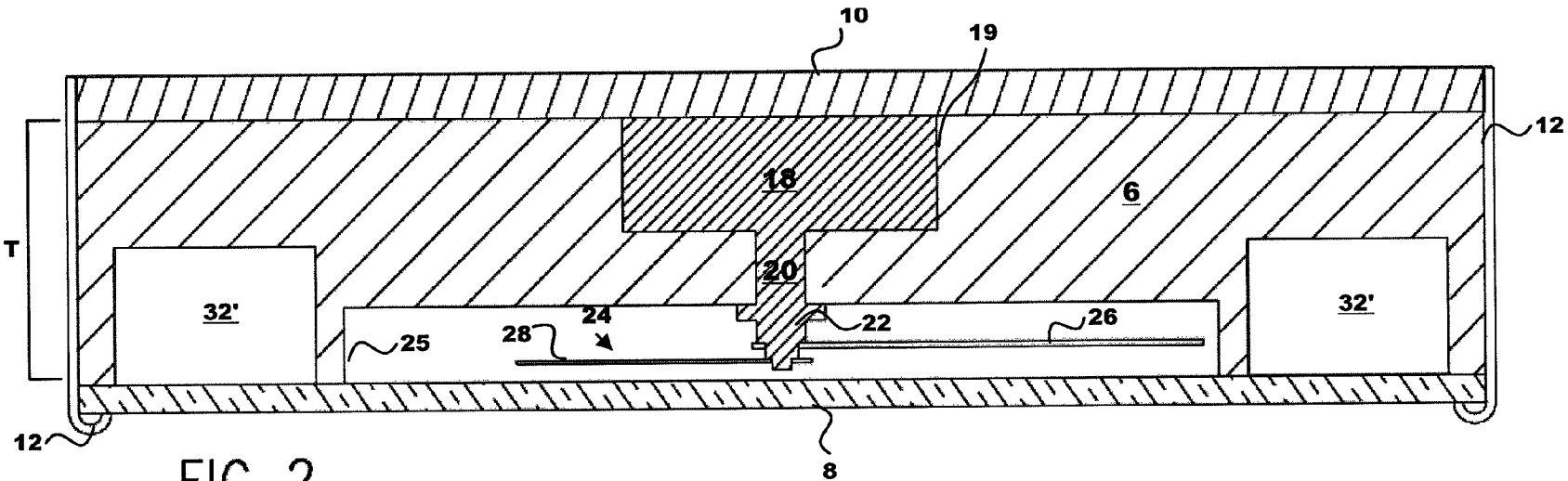
FIG. 2 is a cross-sectional view of the clock of FIG. 1A, illustrating a first manner of inserting collectibles in a first section of the clock, in accordance with at least some embodiments of the present invention.

Turning now to FIG. 2, a cross-sectional view of the clock 2, illustrating one exemplary manner of placing collectibles within the clock, is shown, in accordance with at least some embodiments of the present invention. In particular, FIG. 2 illustrates an embodiment in which recesses 32' for holding collectibles are provided within the core 6, and, more particularly, the recesses 32 extends only partially through the core 6 of the clock 2. Also shown in FIG. 2 are the face plate 8 and the back plate 10 connected together in operational association with the core 6 by the outer rim 12. The clock movement 18 is positioned within the opening 19 on the back surface 16 of the core 6 and includes a shaft 20 extending therefrom through the thickness portion T of the core 6. The shaft 20 receives the dial 22 on the front surface 14 of the core 6. Also, shown are the minute and the hour hands 26 and 28, respectively, which are positioned within the recess 25 of the core 6. Notwithstanding the fact that in the present embodiment, the indicator arms 24 are shown in the recess 25, in at least some other embodiments, as shown in FIG. 4, the indicator arms need not be in the recess, but rather, can be provided on the front surface 14 of the core 6.

With respect to the recesses 32' in particular, they extend only partially through the thickness portion T of the core 6. Collectibles can be placed in the recesses 32' from the front surface 14 of the core 6. For this, the face plate 8 of the clock 2 can be removed thereby exposing the front surface 14 and recesses 32 of the core 6. Typically, the depth of the recesses 32' can vary as desired depending upon the dimensions of the collectible to be displayed. For example, for displaying coin collectibles, the width and depth of the recesses need only confirm to the dimensions (e.g., diameter and thickness) of the coin.

Figure 3:
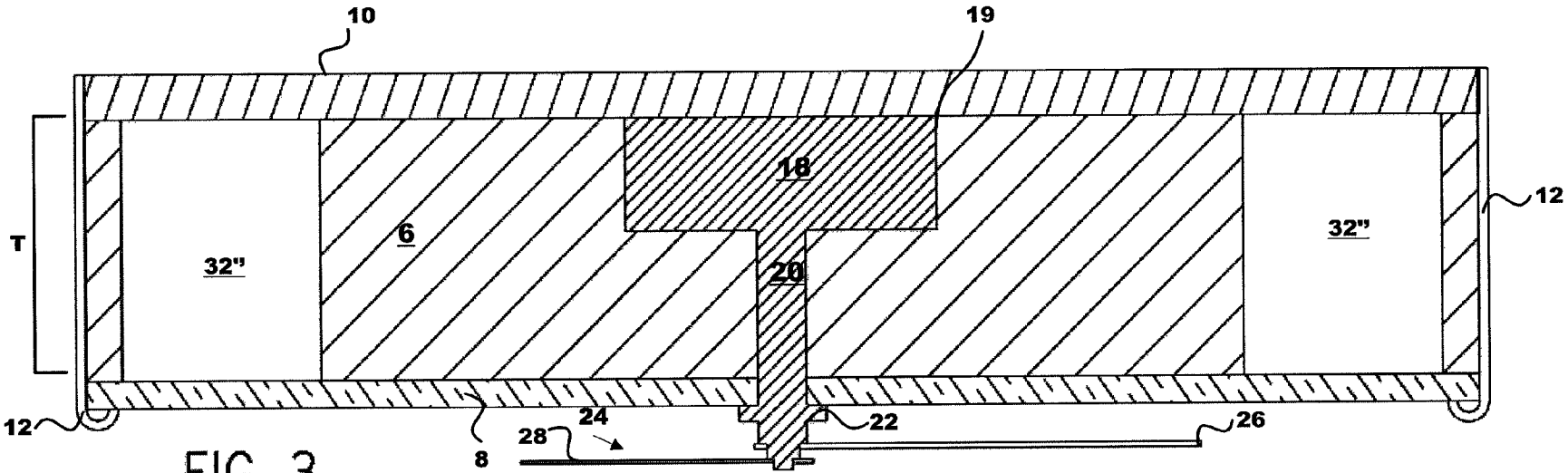
FIG. 3 is a cross-sectional view of the clock of FIG. 1A, illustrating a second manner of inserting collectibles in the first section of the clock, in accordance with at least some embodiments of the present invention.

Referring now to FIG. 3, in at least some embodiments of the present embodiment, recesses 32" extend through the entire thickness T of the core 6 to accommodate collectibles of greater thicknesses, such as, Hot Wheels® cars, Beanie Babies® toys, Star Wars® actions figures. With recesses 32" extending through the entire thickness of the core 6, collectibles can be placed either from the front surface 14 by removing the face plate 8, or, alternatively, from the back surface 16 by removing the back plate 10. For collectibles smaller than the width of the recesses, one or more adaptors can be used to secure the collectible in position. Also, as shown in FIG. 3, the dial 22 and the indicator arms 24 need not always be placed within the recess 25 (See FIG. 2) of the core 6. Rather, in at least some embodiments of the present invention, as shown, the dial 22 and the indicator arms 24 can be located on the top of the face plate 8. Notwithstanding the fact that in the present embodiment, the dial 22 and the indicator arms 24 are shown on the top of the face plate 8, in alternate embodiments the dial and the indicator arms can extend beyond the face plate when the cut-outs 32 extend either partially through the core 6 (See FIG. 2) or are within the face plate (See FIG. 4), as will be described below. Relatedly, in the embodiment of FIG. 3, the dial 22 and the indicator arms 24 can be similarly positioned as that shown in FIG. 2.

Figure 4:
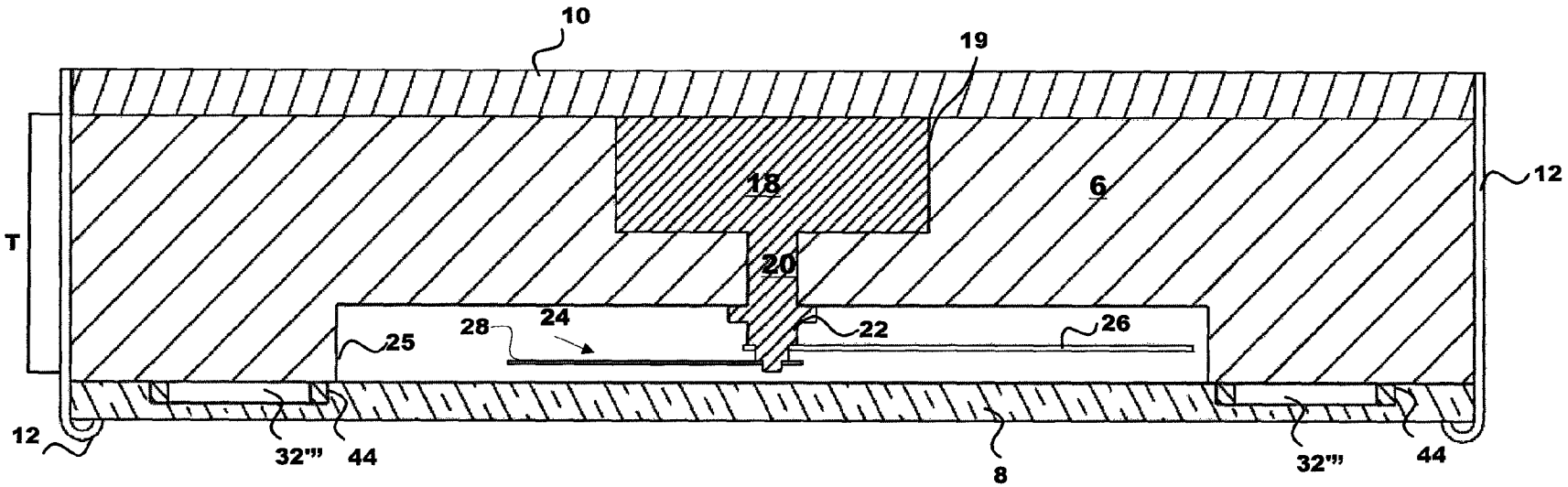
FIG. 4 is a cross-sectional view of the clock of FIG. 1A, illustrating inserting collectibles in a second section of the clock, in accordance with at least some embodiments of the present invention.
Figure 5A:
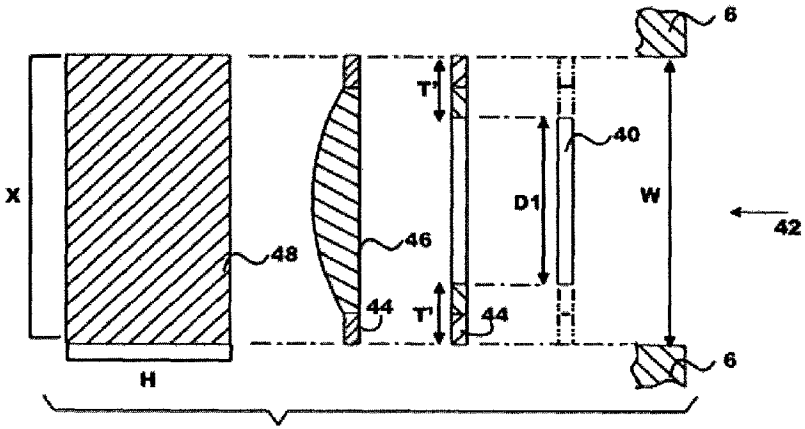
FIGS. 5A-5B are cross-sectional views of exemplary adaptors for securing collectibles in positions of FIGS. 2, 3, and 4 within the clocks of FIG. 1A, in accordance with at least at least some embodiments of the present invention.
Figure 5B:
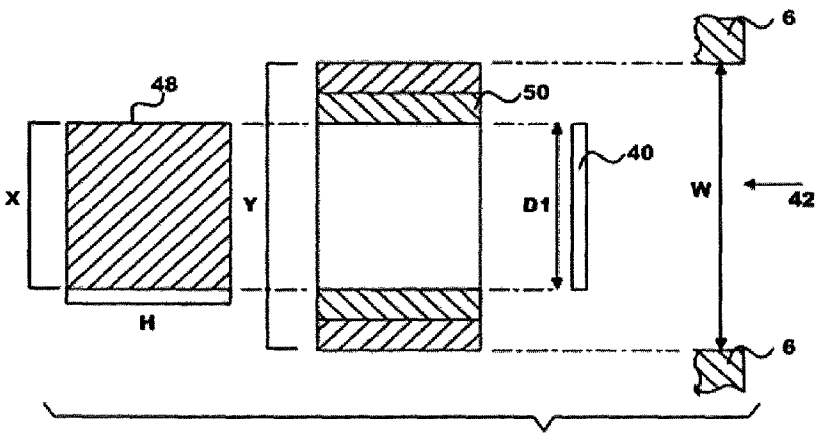

Additionally, the recesses 32' and 32" for holding collectibles need not always be provided in the core section 6 of the clocks 2 and 4, but rather, as shown in FIG. 4, recesses 32'" can be provided in the face plate 8 of the clocks 2 and 4. Collectibles in the face plate 8 can typically be secured by applying pressure to the collectible from the recess 32'" itself and, where applicable, the front surface 4 of the core 6, without requiring any adaptors. However, one or more adaptor can be used with recesses 32'" where desired Collectibles that are placed within the recesses 32', 32" and 32'" and that are smaller than those recesses 32, 32', 32", 32'" can be susceptible to movement and/or displacement within the recesses. To avoid any such movement, at least some embodiments of the present invention provide a wide variety of adaptors, some of which are shown in FIGS. 5A-5B. Such adaptors can be particularly advantageous in situations when a collectible of a smaller size is placed within a recess of relatively bigger size. The various adaptors provided herein include, but are not limited to, rings, solid plugs, pressure plugs and tubes, as explained below.

Referring now to FIGS. 5A-5B, cross-sectional views of exemplary adaptors employed for securing a collectible 40 (e.g., coin) in position within a recess 42 is shown, in accordance with at least some embodiments of the present invention. While the present embodiment is explained by way of securing a coin 40 within a recess, securing other collectibles (e.g., collector cards, golf balls) are contemplated and considered within the scope of this disclosure. Referring particularly to FIG. 5A, the collectible 40 is secured by way of a ring 44, a pressure plug 46, which is a compressible plug typically positioned behind the collectible and a solid plug 48, which is rigid, non-compressible plug, positioned behind the collectible, behind the pressure plug and/or inserted within a tube 50. As can be seen, the collectible 40 is smaller in size with respect to the recess 42. Therefore, to secure the smaller collectible within a bigger recess, a combination of adaptors of increasingly bigger sizes can be used.

For example, as shown in FIG. 5A, the ring 44 having an inner diameter that is same (or substantially same) as that of the diameter D1 of the collectible 40 can be placed around the collectible for support. The thickness T' of the ring can conform to the widest width W of the recess 42, or alternatively, a multitude of rings with increasingly greater inner diameters and reduced thicknesses can be placed around the ring. Further, each of the rings 44 can be made of any of a wide variety of suitable material. For example, in at least some embodiments of the present embodiment, the rings can be made of plastic, wood, metal and rubber. In other embodiments, other rigid, semi-rigid or flexible materials can be utilized. Additionally, the rings 44 can be decorated as desired, such that the rings when visible from the front surface of the core conform to the general theme of the collectible 40.

The ring 44 can additionally be supported by the pressure plug 46 and the solid plug 48. The pressure plug 46 applies an even pressure to the collectible 40, thereby pushing the collectible within the recess 42 to be flush with the front surface 14 of the core 6. In at least some embodiments of the present invention, the pressure plug 46 is designed to have a first flat surface that is positioned behind the collectible 40 and a convex or substantially convex second surface opposite the first surface for distributing the pressure on the collectible 40 evenly across the collectible 40. Notwithstanding the structure of the pressure plug 46 described above, in at least some other embodiments of the present invention, the pressure-plug can assume a different shape, including both geometrical and non-geometrical shapes. The pressure plug 46 can be made of any suitable compressible material, such as, foam, silicone and rubber.

The ring 44 and the pressure plug 46 can additionally be pressed against the front surface 14 with the solid plug 48, which is constructed out of a rigid material such as glass, wood. The solid plug 48 applies to the convex or substantially convex surface of the pressure plug 46, thereby pushing the collectible 40 (and the rings(s)) against the edge of the recess 42. Typically, the width X of the solid plug 48 is no greater than the width W of the recess 42 and the height H of the solid plug can vary as desired, but, preferably is no more than the depth of the recess 42.

Although a particular arrangement of the ring 44, the pressure plug 46 and the solid plug 48 has been explained above, in at least some embodiments, this arrangement varies. For example, as already mentioned above, additional rings of increasingly bigger sizes can be utilized for holding the collectible 40 within the recess 42. Relatedly, additional pressure plugs and solid plugs can be used. Further, all three adaptors (i.e., the rings, the pressure plug and the solid plug) for securing the collectible 40 in position need not always be used. Rather, a combination of one or more of the ring 44, the pressure plug 46 and the solid plug 48 can be utilized in other embodiments.

Referring now to FIG. 5B, the collectible 40 is held in position within the recess by way of the tube 50. The tube 50 is designed as a series of hollow concentric cylinders, each constructed out of a compressible material such as silicone or rubber. The width Y of the tube 50 generally conforms to the width W of the recess 42 and the height of the tube can vary as desired but, preferably, is no greater than the depth of the recess. Further, as shown, in at least some embodiments, the portions of the tube 50 can be removed and replaced by a solid plug 48. Advantageously, the tube 50 serves as a ring 44 and a pressure plug 46 combined thereby eliminating the need for using rings and pressure plugs. Nonetheless, both rings and pressure plugs can be employed along with the tube 50 in alternate embodiments.

In operation, the desired collectibles can be placed within the recesses (32', 32" and 32'") and secured in position by way of one or more of the adaptors (e.g., rings, pressure plugs, solid plugs, tubes). The clocks 2 and 4 can be customized by the consumer or the manufacturer and/or retailer of the clocks 2 and 4. In particular, changing, replacing and/or adding collectibles within the clock can be accomplished by opening at least one of the face plate 8 and the back plate 10. Further, the collectible(s) already displayed within the clocks 2 and 4 can be removed and replaced by a second set of collectible(s). The second set of collectible(s) can additionally be secured by way of one or more adaptors, described above. Subsequently, the face plate 8 and/or the back plate 10 that was removed for removing the collectible(s) can be replaced to secure the collectibles in position. Additionally, the clocks 2 and 4 described herein can be sold as a kit in which a clock is accompanied by an assortment of the aforementioned adaptors for customization and replacement of the collectibles by the user. Additional decorative and/or functional components can be included in the kit.

In addition to the embodiments described above with respect to FIGS. 1A-5B, additional embodiments including a wide variety of additions and/or refinements to the various features set forth above are also contemplated. For example, the shape, size and orientation of the various components of the invention can vary from one embodiment to another. While the clocks 2 and 4 shown in the present embodiment are round (or substantially round) in shape, clocks of other shapes and designs are contemplated and considered within the scope of the disclosure. Relatedly, the shapes, sizes and orientations of the recesses can vary. With respect to the adaptors, any combination of one or more of those adaptors can be utilized for securing the collectibles in position. The exact shapes, sizes and types of the adaptors can vary.

Despite any method(s) being outlined in a step-by-step sequence, the completion of acts or steps in a particular chronological order is not mandatory. Further, modification, rearrangement, combination, reordering, or the like, of acts or steps is contemplated and considered within the scope of the description and claims.

It is specifically intended that the present invention disclosure not be limited to the embodiments and illustrations contained herein, but include modified forms of those embodiments including portions of the embodiments and combinations of elements of different embodiments as come within the scope of the following claims.

We claim:

1. A clock for displaying collectibles, the dock comprising: a core having a first surface, a second surface opposite the first surface and a thickness portion connecting the first and the second surfaces, the first surface having formed therein a plurality of recesses, each of the plurality of recesses having a depth configured and dimensioned to receive a collectible; a first structure removably attachable to the first surface of the core; and a clock movement received in an opening in the core, further comprising at least one adaptor configured and dimensioned to be received in one of the recesses, wherein the at least one adaptor comprises a plug having a first side that is flat or substantially flat that can be positioned behind the collectible and a second side opposite the first side that is convex or substantially convex.

2. A clock for displaying collectibles, the clock comprising: a core having a first surface, a second surface opposite the first surface and a thickness portion connecting the first and the second surfaces, the first surface having formed therein a plurality of recesses, each of the plurality of recesses having a depth configured and dimensioned to receive a collectible; a first structure removably attachable to the first surface of the core; and a clock movement received in an opening in the core, further comprising at least one adaptor configured and dimensioned to be received in one of the recesses, wherein the at least one adaptor comprises a plurality of compressible concentric cylinders, the plurality of concentric cylinders positioned within one another such that cylinders of increasingly smaller diameters are placed within the cylinders of increasingly larger diameters, the largest diameter being no greater when compressed than the width of the respective one of the plurality of recesses, wherein the height of each of the plurality of cylinders is no greater when compressed than the depth of the respective one of the plurality of recesses.

3. The clock of claim 1, wherein the plug is a compressible structure having a diameter when the plug is compressed no longer than the width of the respective one of the plurality of recesses formed within the first surface of the core.

* * * * *